US008196743B2

(12) United States Patent
Stingel et al.

(10) Patent No.: US 8,196,743 B2
(45) Date of Patent: Jun. 12, 2012

(54) NEEDLE-RECEIVING DEVICE

(75) Inventors: Uwe Stingel, Messstetten (DE); Johannes Bruske, Albstadt (DE); Hans-Joachim Halamoda, Albstadt (DE)

(73) Assignee: Groz-Beckert KG, Albstadt (DE)

( * ) Notice: Subject to any disclaimer, the term of this patent is extended or adjusted under 35 U.S.C. 154(b) by 0 days.

(21) Appl. No.: 11/979,593

(22) Filed: Nov. 6, 2007

(65) Prior Publication Data

US 2008/0105577 A1 May 8, 2008

(30) Foreign Application Priority Data

Nov. 7, 2006 (EP) ..... 06023122

(51) Int. Cl.
*B65D 85/28* (2006.01)

(52) U.S. Cl. ..... 206/380; 206/443; 206/449; 206/574; 206/338; 206/340

(58) Field of Classification Search ..... 206/380, 206/382, 383, 574, 381, 39, 39.1, 39.2, 443, 206/449, 338, 340; 24/67.9
See application file for complete search history.

(56) References Cited

U.S. PATENT DOCUMENTS

| | | | | | |
|---|---|---|---|---|---|
| 1,559,698 | A | * | 11/1925 | Henter | 24/3.12 |
| 2,549,200 | A | * | 4/1951 | Hooks | 24/67.9 |
| 2,551,012 | A | * | 5/1951 | Kenah | 211/60.1 |
| 2,771,187 | A | | 11/1956 | Haile | |
| 3,566,083 | A | * | 2/1971 | McMillin | 250/566 |
| 5,366,083 | A | * | 11/1994 | Sos et al. | 206/380 |
| 5,913,618 | A | * | 6/1999 | Yosha | 40/658 |
| 5,944,080 | A | * | 8/1999 | Podwika | 150/147 |
| D486,862 | S | * | 2/2004 | Coe | D19/65 |
| 7,341,150 | B2 | | 3/2008 | Fäller | |
| 2004/0163993 | A1 | | 8/2004 | Faller | |

FOREIGN PATENT DOCUMENTS

| | | |
|---|---|---|
| BE | 538 880 A | 6/1995 |
| DE | 260 953 C | 8/1912 |
| DE | 258 019 | 3/1913 |

* cited by examiner

*Primary Examiner* — J. Gregory Pickett
*Assistant Examiner* — Blaine Neway
(74) *Attorney, Agent, or Firm* — Fitch, Even, Tabin & Tabin, LLP

(57) ABSTRACT

A needle-holding device (1) suitable in particular as a package comprises a flat needle carrier section (4) and an adjoining section that has a clamping lip (5) that is resiliently biased against the needle carrier section (4). The clamping lip (5) reaches around the stitch-forming sections of the needles (2) which are held lying next to each in contact with each other on the needle carrier section (4). The resiliently yielding clamping lip (5) permits the insertion and the pull-out of one, several or of all the needles (2).

6 Claims, 8 Drawing Sheets

22
6
9
5
8
7
24
25
$h_1$
3
4
23
28
29
26
27
30
31

6
9
24
28
27
29
26
5
25
31
8
23
36
32
37
35
33
34
38

NEEDLE-RECEIVING DEVICE

CROSS REFERENCE TO RELATED APPLICATION

This application claims the priority of European Patent Application No. 06 023 122.2, filed on Nov. 7, 2006, the subject matter of which, in its entirety, is incorporated herein by reference.

BACKGROUND OF THE INVENTION

The invention relates to a needle-receiving device that is suitable for packaging several needles which can be kept protected and ready for use in a given order.

Different types of needle-receiving devices and needle packages have been known. For example, DE Patent 258019 discloses an auxiliary device for knitting machines for easier replacement of needles. This auxiliary device includes two rails which are held together by tension by means of a clamp. Between said rails, the needles can be grasped either on their rear or on their front hook-side end, thereby being clamped between the rails.

Furthermore, DE Patent 260953 discloses a clamping device with two strips, between which needles are clamped in place parallel to and at a distance from each other. This clamping device also is disposed to act as an auxiliary device to facilitate the exchange of needles.

U.S. Pat. No. 2,771,187 shows an envelope-type package for sewing needles in an envelope that is configured as a pocket for storing needles. After sliding the needles into the receiving pocket, the envelope is closed.

It is the object of the invention to provide a holding device, in particular for needles of knitting machines, said device being suitable as a needle package.

SUMMARY OF THE INVENTION

The above object generally is achieved with the holding device in accordance with Claim 1:

The holding device in accordance with the invention comprises a flat needle carrier section and a clamping lip opposite thereto. The clamping lip is bent in the direction of the needle carrier section and can be biased toward the needle carrier section. The clamping lip is disposed to bridge one end of the needle arranged in between and to clamp and thus hold the needle against the needle carrier section. Referring to this holding device, many needles may be arranged side by side, as desired, in which case the clamping lip holds the needles tensioned against the needle carrier section. In so doing, the clamping lip and the needle carrier section are preferably in direct contact with the needles.

One advantage of the concept of the holding device in accordance with the invention is that—different from needle bundles using elastic cords, O-rings, wires, rubber rings, etc., virtually any size group of needles can be accommodated in one needle-receiving device. After removing a few needles, the remaining needles continue to be held as an assembly by the needle-receiving device.

Different from packages of needles or other longitudinal knitting tools on wires or nylon cords, the knitting tools or needles to be accommodated by the inventive needle-receiving device do not require separate, marked openings.

Referring to the needle-receiving device in accordance with the invention, the clamping lip is bent in the direction of the needle carrier section. In so doing, the distance between the underside of the clamping lip and the upper side of the needle carrier sections is smaller than the height of the knitting tool that is to be accommodated. Consequently, the received knitting tools are biased toward the needle carrier section at such a force that the accommodated needles are automatically held in position. Also, preferably, the clamping lip exhibits a certain elasticity with respect to a direction imagined in a direction transverse to the longitudinal direction of needles, so that said clamping lip uniformly presses all adjacent needles, irrespective of possibly minimal tolerances, against the needle carrier section.

As a result, the needles can be held in the holding device without being connected to each other. It is only the clamping lip that then holds the needles together as a block. However, it is also possible to additionally secure the needles among each other. For example, the needles can be connected to each other by a fixing varnish or by mechanical means such as, for example a rubber cord. If, to achieve this, each of the needles has an appropriate opening therefore and if these openings of the needles are in alignment with each other, a rubber cord may be directly threaded through these openings. If said rubber cord is released, it contracts in longitudinal direction and, in so doing, expands in radial direction. In so doing, said rubber cord can clamp in place needles seated on it so that they form a held-together block. Such a block can be reliably accommodated by the inventive holding device and stored in this manner.

Means for holding or attaching the needles other than the clamping lip may be provided on the holding device. For example, the needle carrier section may comprise structures, for example, configured as angled borders, which prevent a lateral slipping of the held needles. Additionally, the needles can be held down by means of an elastic tape or a suitable package band.

The clamping lip bridges the needles supported by the holding device. Preferably, the free end of the clamping lip that terminates in a pressure point or a contact point with the needle is bent up to such a degree that an easy insertion of the needles to be accommodated is possible. Considering this, the clamping lip preferably has a length in longitudinal direction of the needles such that said clamping lip completely bridges the stitch-forming region of the inserted needle, so that the stitch-forming region is received by the accommodation space provided in the holding device. While the needle back of the needles abuts against the flat needle carrier section along a greater length or along the entire length, the clamping lip pushes against each needle at only one point.

Referring to a preferred embodiment, the receiving device consists of at least two parts, namely, one configured as a needle-holding clip and one configured as a carrier plate connected to said needle-holding clip. In so doing, the clamping lip is configured as part of the needle-holding clip. While the needle-holding clip may consist, for example, of plastic material, the carrier plate preferably consists of another material such as, for example, cardboard, the plastic material of the clip, or another plastic material. Furthermore, the needle-holding clip and the carrier plate may consist of the same or different metals. Preferably, the needle-holding clip and the carrier plate are connected to each other, either permanently by riveting, caulking, compressing, cementing, joining or other measures or also detachably from each other.

If the carrier plate itself is absorbent or provided with an absorbent layer, for example, a felt layer or another fabric layer, it may represent a storage means for preservative or treatment substances. As a result of, this it becomes possible to store a substance in the needle-receiving device, for example, a corrosion-preventing agent such as, for example, oil, which is gradually released to the needles in order to protect them. This permits the world-wide shipping of superior-quality needles and their long-term storage, even under adverse environmental conditions.

Preferably, in order to connect the carrier plate with the needle-holding clip, a slit is provided in one of the limbs of the needle-holding clip, in which the carrier plate is inserted. The slit may be limited by two walls having the same or different lengths. Preferably, a front edge of the wall facing the knitting tools or needles is chamfered or ramped, thus facilitating insertion of the needles. If the lower wall away from the needles is longer than the upper wall, the needles are, on the one hand, in contact with the carrier plate along a large length and, on the other hand, the carrier plate is stiffened by the lower wall.

In order to facilitate the insertion of the carrier plate in the slit, one of the two walls defining the slit may be chamfered, curved or tapered at the mouth of the slit.

Furthermore, it is considered advantageous to provide positioning means for the carrier plate in the slit. For example, the slit may have inside ribs, between which an edge of the inserted carrier plate is held. In addition, at the ends of the walls that limit the slit, projectors or ribs may be provided, the latter holding or clamping the carrier plate between them. This has the advantage that the carrier plate is held or supported by two strip-shaped or line-shaped areas that are at a distance from each other. This is used for the precise relative alignment of the carrier plate and the needle-holding clip. If necessary, the slit may contain a binder such as an adhesive, which connects the carrier plate in a substance-closed manner with the needle-holding clip.

The carrier plate may not only be held in the slit in a substance-closed manner; it is also possible to connect the carrier plate with the needle-holding clip in a form-closed manner. For example, this is possible with ribs that have more or less sharp edges that press on one or both sides into the carrier plate and that are connected to the needle-holding clip.

Referring to a needle-receiving device that is particularly conveniently actuated and suitable for the storage of particularly sensitive knitting tools or needles, the needle-holding clip is associated with an actuation device. Preferably, the actuation device—when actuated—is disposed to move the clamping lip away from the carrier plate so that the needles can be easily pushed between the clamping lip and the carrier plate. When being inserted or being removed, the needles need not come up with the force that is required for opening the clamping lip. Suitable actuation devices are, for example, extensions that project approximately parallel or at an acute angle with respect to each other beyond the elastic region that connects the clamping lip with the carrier plate.

Additional details of advantageous embodiment of the invention are obvious from the drawings, the description of the figures and the claims. The description of the figures explains essential aspects of the invention and other facts. A number of modifications is possible. As usual, additional details are obvious from the drawings to persons skilled in the art, said drawings supplementing the description of the figures. The drawings are not true to scale.

DETAILED DESCRIPTION OF THE INVENTION

Figure 1:
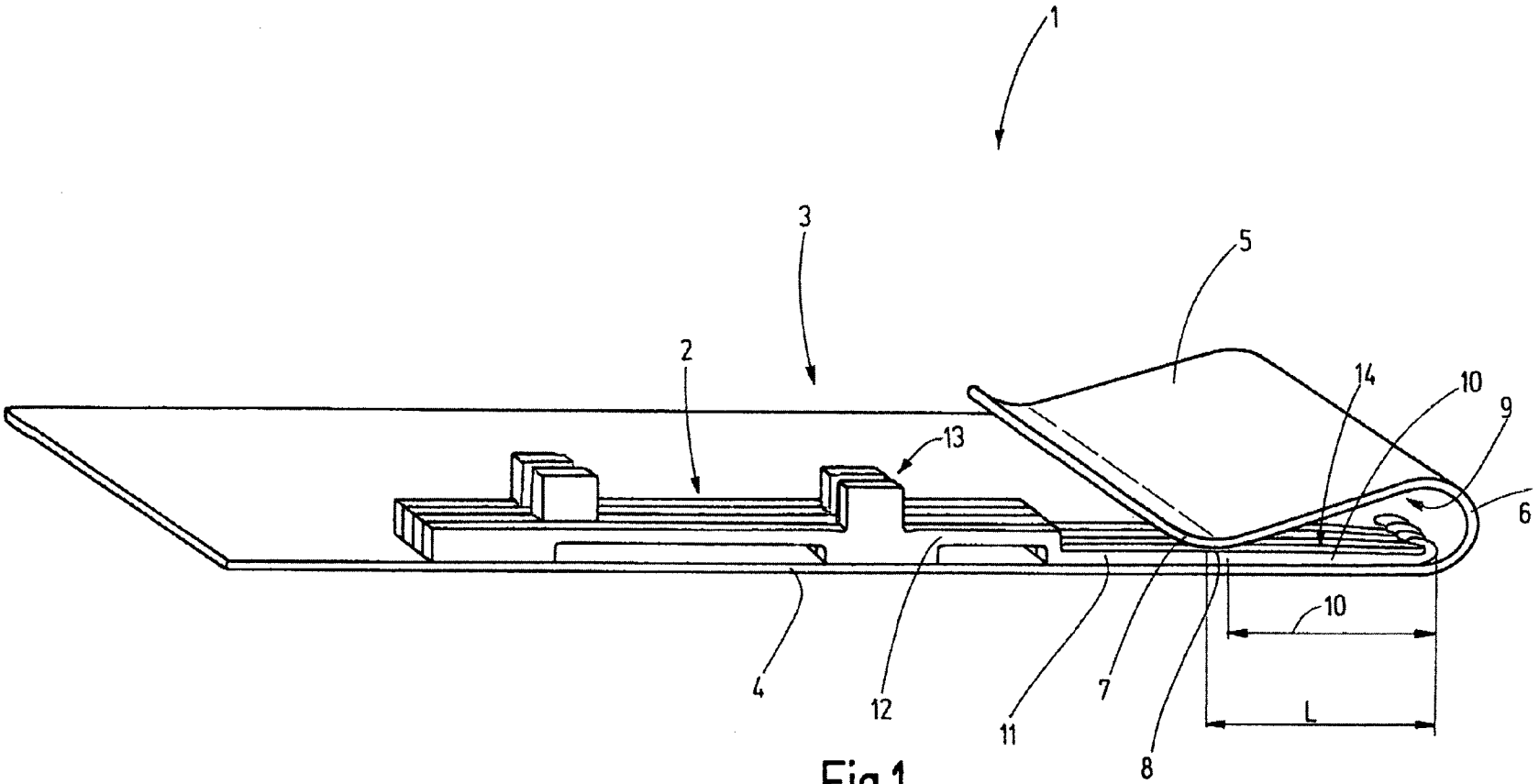
FIG. 1 is a schematic, perspective illustration of a needle-receiving device with several needles.

FIG. 1 shows a needle-holding device 1 with needles 2 that are accommodated in the needle-holding device 1. The needle-holding device 1 is disposed to act, for example, as a needle package for shipping and storing needles, and for keeping them readily available. This device can also form only a part of a needle package. The needle-holding device 1 comprises a receiving device 3, to which belong a flat needle carrier section 4 and, arranged opposite thereto, a clamping lip 5. The flat, preferably plane, needle carrier section 4, which is rectangular in plan view, and the clamping lip 5 are connected to each other by an arcuate spring section 6, for example. This spring section pretensions the clamping lip 5 against the needle carrier section 4 and holds the clamping lip 5 so that it can be pivoted at the same time. This spring section represents a spring-biased hinge. The clamping lip 5 and the needle carrier section 4 can be connected in one piece via the spring section 6. In the simplest case, the needle carrier section 4, the clamping lip 5 and the spring section 6 consist of a suitable, relatively stiff yet slightly flexible material such as, for example, a plastic material.

While the needle carrier section 4 is largely planet, the clamping lip 5 preferably has an edge 7 that is bent away from the needle carrier section. In so doing, the clamping lip 5 approaches—starting at the spring section 6, initially at an acute angle—the needle carrier section 4 until it reaches a contact point 8 at which it contacts the needles 2 and then extends—again at an acute angle to form an insertion funnel—toward the needle carrier section 4 away from the contact point 8 and the needle carrier section 4. In this manner, the clamping lip 5 encloses and inside space 9, into which extend the stitch-forming sections 10 of the needles 2. These stitch-forming sections comprise the hooks of the needles, the needle breast and a part of the needle shaft. The inside space 9 has an appropriate length L that is defined by the length of the clamping lip 5, that is, the distance of the contact point 8 from the spring section 6. The clamping lip 5 is shorter than the shafts 11 of the needles 2, so that the remaining parts 12 of the needle bodies adjoining a step and their feet 13 are located outside the inside space 9 and lie on the needle carrier section 4.

As is illustrated by FIG. 1, the needles 2 are pressed firmly against the needle carrier section 4 due to the clamping action of the clamping lip 5 and are thus held as a block. An end 14 defined by the stitch-forming part 10 of each needle 2 is held in the inside space 9, while the remaining parts 12 of all needles 2 remain outside this inside space 9. Thus the needles 2 are held only by the clamping action of the clamping lip 5 on the needle shaft between the stitch-forming part and by a step adjoining the shaft. In order support the fixation of the needles 2, the needle carrier section 4 may be made such that the coefficient of friction between the underside of the needle (needle back) and the needle carrier section 4 is as high as possible. This can be achieved by selecting suitable materials for the needle carrier section 4, for example, rough cardboard, or by selecting a suitable coating. Increased friction can also be achieved by applying structures in the form of small elevations, strips or nubs. As a result of this, it is hardly possible to laterally move the needles on the carrier plate 4.

Figure 2:
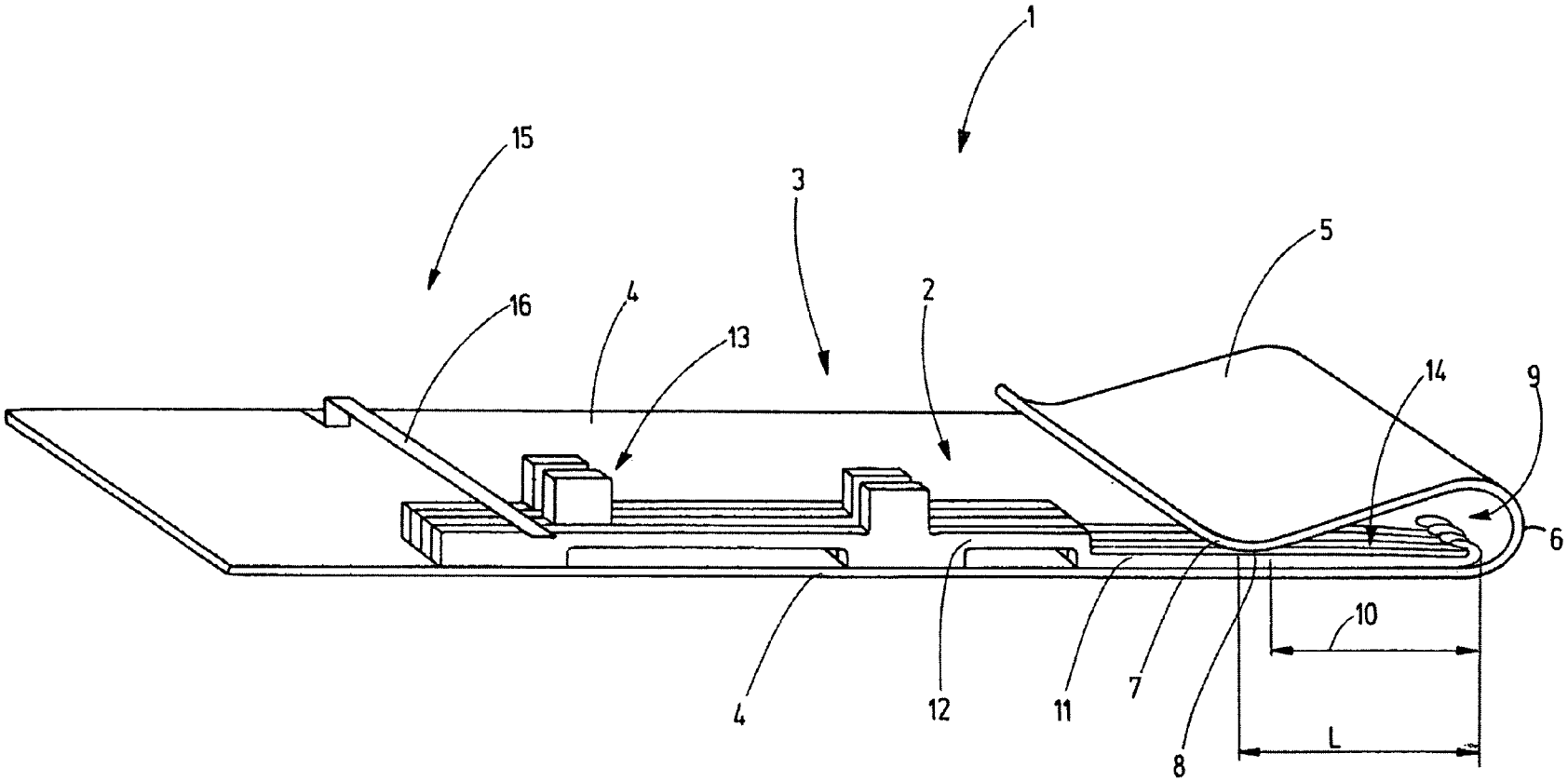
FIG. 2 is a schematic, perspective illustration of a modified embodiment of the needle-receiving device.

As is illustrated by FIG. 2, additional means 15 may be provided for the fixation of the needles 2 on the needle carrier section 4. Such means 15 may be configured, for example, as one or more bands 16, each bridging the needles 2 in transverse direction and additionally holding them. Such bands 16 can also be used as the original seal. As shown, they may be provided on the free end of the needles 2 or also between their feet 13. In this case, it is necessary to remove said band before the needles 2 can be taken out. If the bands 16 consist of paper or plastic material, they must be torn or cut off. Alternatively, if an original seal is not required, it is possible to provide resealable bands 16. Other than that, the description of FIG. 1 applies to the embodiment in accordance with FIG. 2, using as basis the already established reference numbers.

Figure 3:
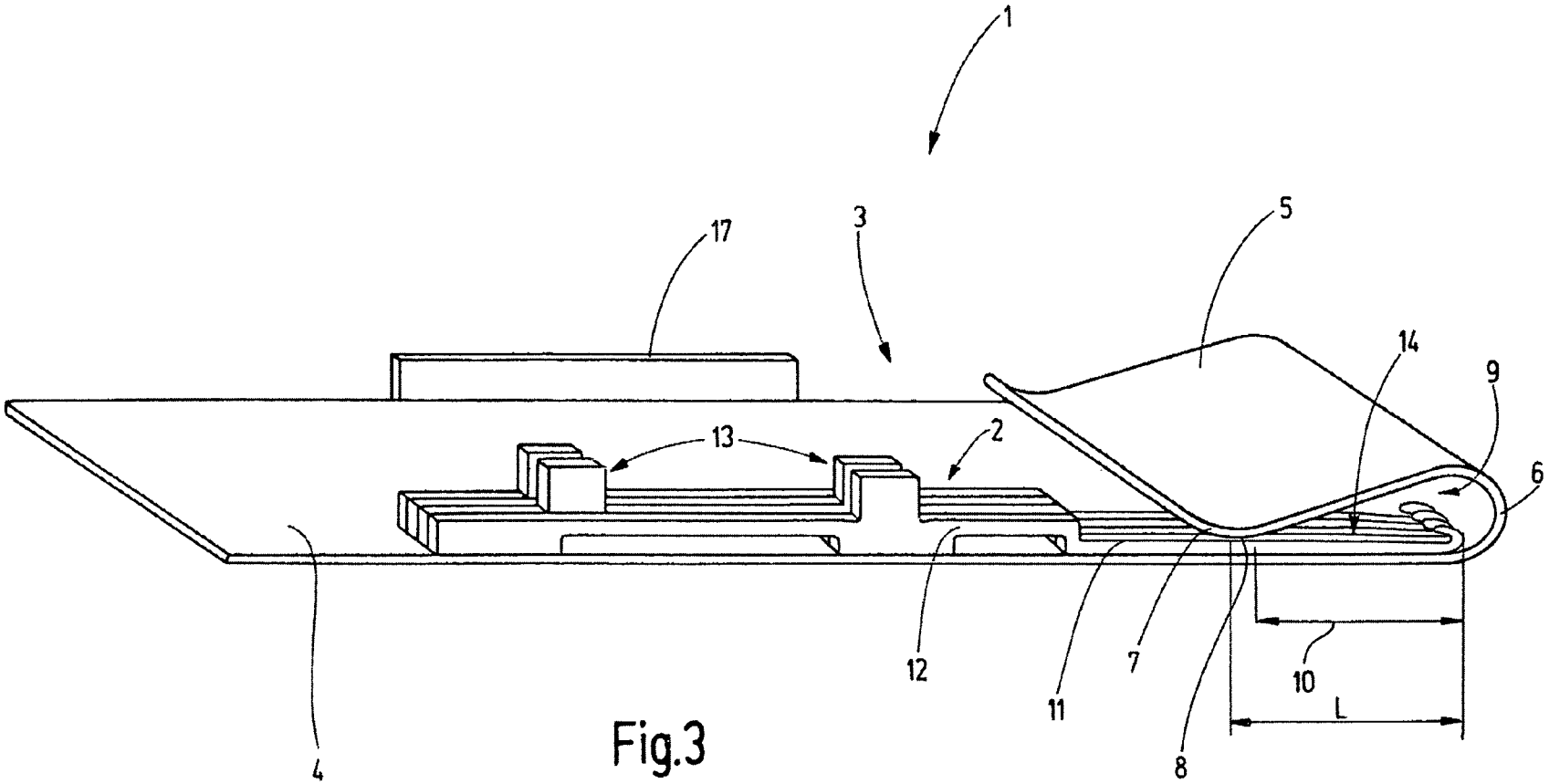
FIGS. 3 and 4 are a schematic, perspective illustration of another modified embodiment of the needle-receiving device.

FIG. 3 shows another modification. The above description of FIG. 1 or, alternatively, of FIG. 2, applies to FIG. 3 accordingly. In addition, the needle carrier section 4 has one or more projections, for example, configured as a border 17 that is bent at an angle parallel to the needles 2. Likewise, a not specifically shown bent border may be provided in FIG. 3 on the opposing longitudinal edge of the needle carrier section. A package band, a rubber band or another package, for example, configured as a plastic bag, as plastic heat-shrinkable tubing or the like, may be tightly wrapped around the border 17.

Figure 4:
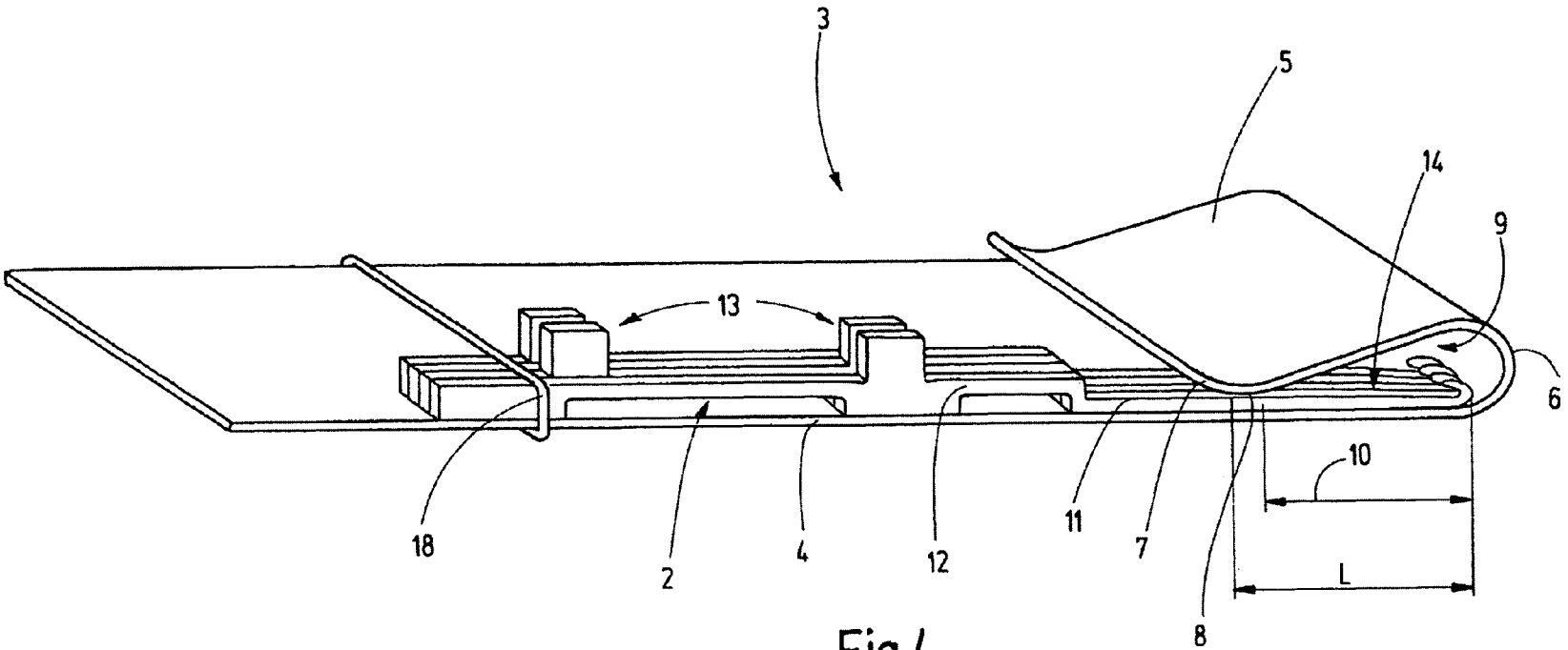

FIG. 4 shows another modification of the needle-holding device 1. Based on the embodiment in accordance with FIG. 1 or also in accordance with the embodiments in accordance with FIG. 3 or 2, the needles 2 can be held together by a rubber band 18, which stretches around the needle carrier section 4 and the needles 2.

Figures 5, 6:
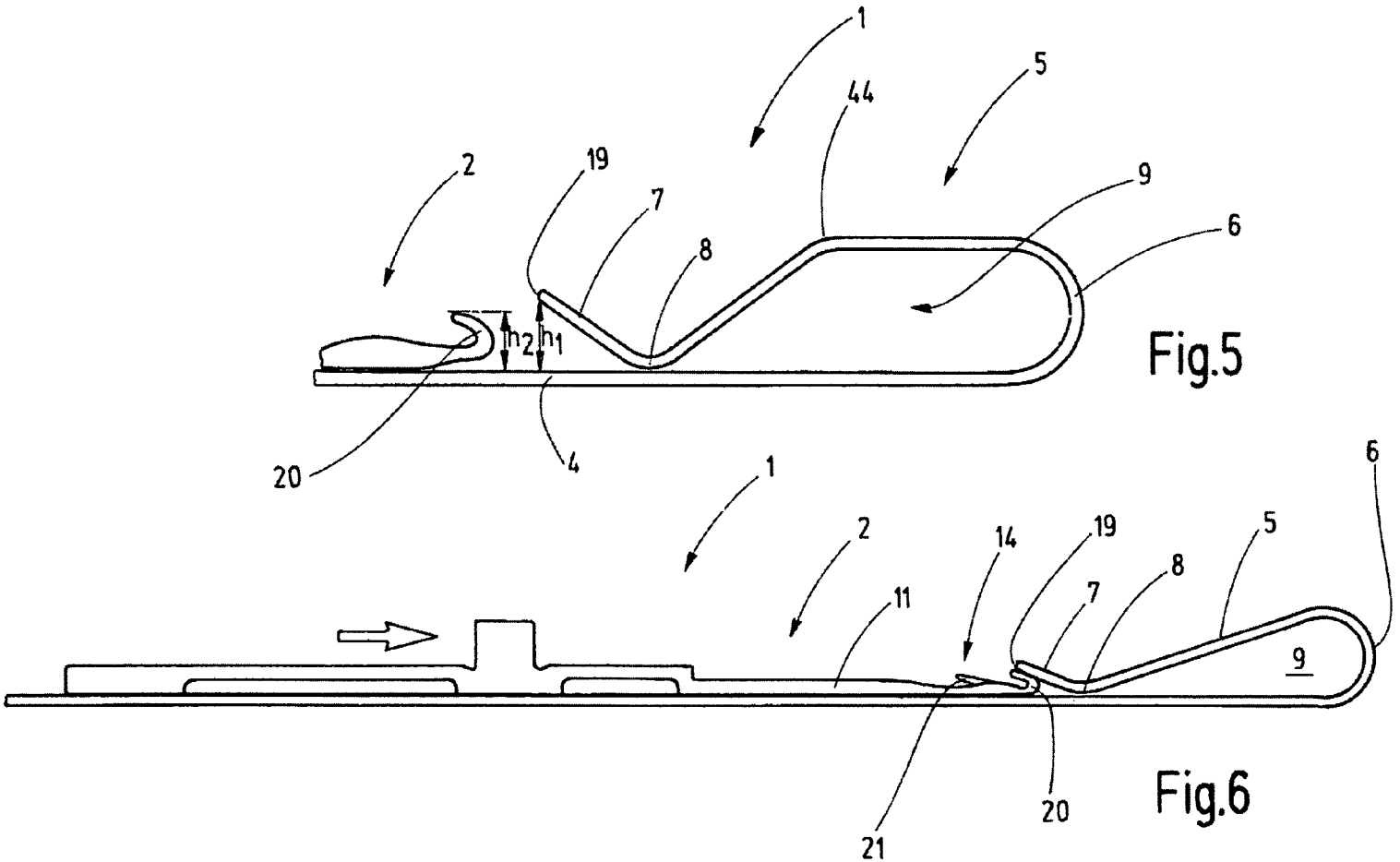
FIGS. 5 and 6 show different sizes of the needle-receiving device in accordance with FIG. 1, while the needle is being inserted.

FIGS. 5 and 6 show additional details of the embodiments of the needle-holding device 1 described so far. As is obvious, the clamping lip 5 may be configured essentially flat or also be bent along a bending line 44 that extends transversely to the needles 2. In both cases, the edge 7 terminates in an edge 19 having a distance $h_1$ from the needle carrier section 4—when no needle is inserted in the inside space 9—that is greater than the height $h_2$ of the upper side of a hook 20 of a needle 2 positioned with its needle back on the needle carrier section 4. In so doing, the bias of the spring section 6 may be such that the contact point 8 of the clamping lip 5 abuts against the needle carrier section 4 or defines a narrow gab therewith. In any event, this gap is smaller than the height of the shaft 11 of the needle 2 that is to be supported. In addition, the potential spring stroke of the spring section 6 is greater than the height $h_2$.

Operation of the Needle-holding Device 1:

In order to insert the needles 2 into the needle-holding device 1, they are pushed under the edge 7 as shown in FIG. 6. In so doing, they slide into the inside space 9. In so doing, the contact point 8 moves over the hook 20 and the stitch-forming section 10 of each needle 2. Finally, the hooks 20 of the needles, as well as potentially existing latches 21 (FIG. 6) enter into the inside space 9, where they do not experience any additional contact with other parts. The contact point 8 keeps a safe distance from the hook 20 and from the latch 21. Thus the clamping lip reaches around the stitch-forming part 10 of each needle 2.

Figures 7, 8, 9:
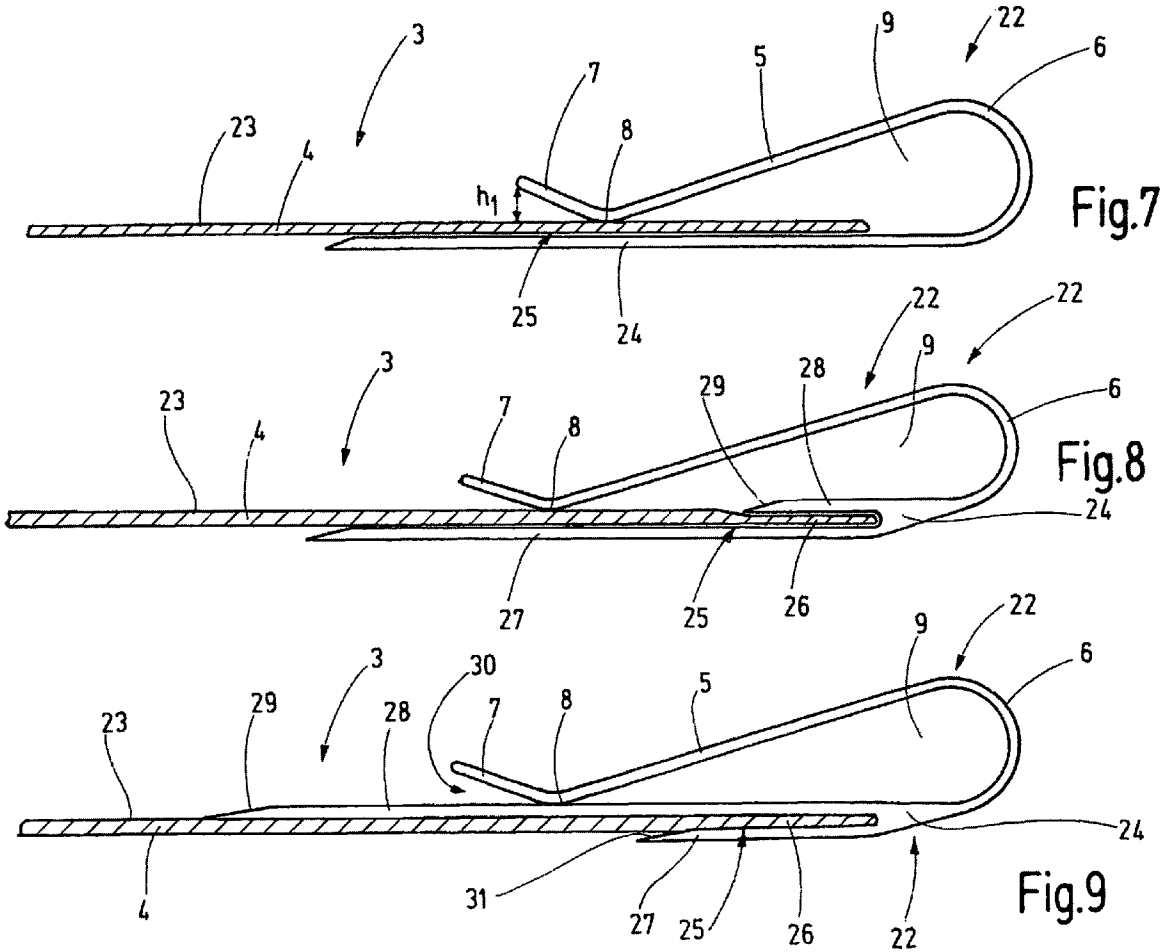
FIGS. 7 through 11 show various embodiments of a two-part needle-receiving device with needle-holding clip and carrier plate.

Additional details and embodiment options of the invention are described hereinafter. These embodiment options can be used in all above-described embodiments. Referring to FIG. 7, the needle carrier section 4 and the clamping lip 5, along with the spring section 6, may be configured as separate parts that consist of the same or different materials and are connected to each other. For example the receiving device 3 may be formed by a needle-holding clip 22 and a needle carrier plate 23. The carrier plate 23 is made of cardboard, for example, while the needle-holding clip 22 consists of plastic material, for example. The needle-holding clip 22 is an element that consists of three parts. Via the spring section 6, the clamping lip 5 is connected to the limb 24 that supports the carrier plate 23. Via a connecting means 25, the carrier plate 23 is connected to the limb 24. This is achieved, for example, by means of an adhesive joint, where a large area of the carrier plate 23 is cemented to the limb 24. Preferably, the limb 24 is longer than the clamping lip 5. Using the contact point 8, the clamping lip 5 can press the carrier plate 23 against the limb 24.

As is shown by FIGS. 8 through 11, the connecting means 25 may also comprise a slit 26 that is formed in the limb 24. FIG. 8 shows a first such embodiment. The slit 26 is aligned parallel to the carrier plate 23 and limited by two walls 27, 28. They are arranged parallel to each other, as well as parallel to the carrier plate 23. The carrier plate 23 is inserted in the slit 26 and connected to the needle-holding clip 22. To do so, the connecting means used may be cement, which, for example, connects the wall 27 to the carrier plate 23. Also, cement may be provided in the slit 26 in order to aid the connection.

Furthermore, at least referring to a preferred embodiment, the wall 28 is provided with a chamfer 29 or a ramped surface at its edge bordering the slit 26. This chamfer forms a gently ascending transition from the carrier plate 23 to the surface of the wall 28 that faces the inside space 9. The chamfer 29 facilitates the insertion of the needles into the inside space 9.

Figures 10, 11, 12, 13:
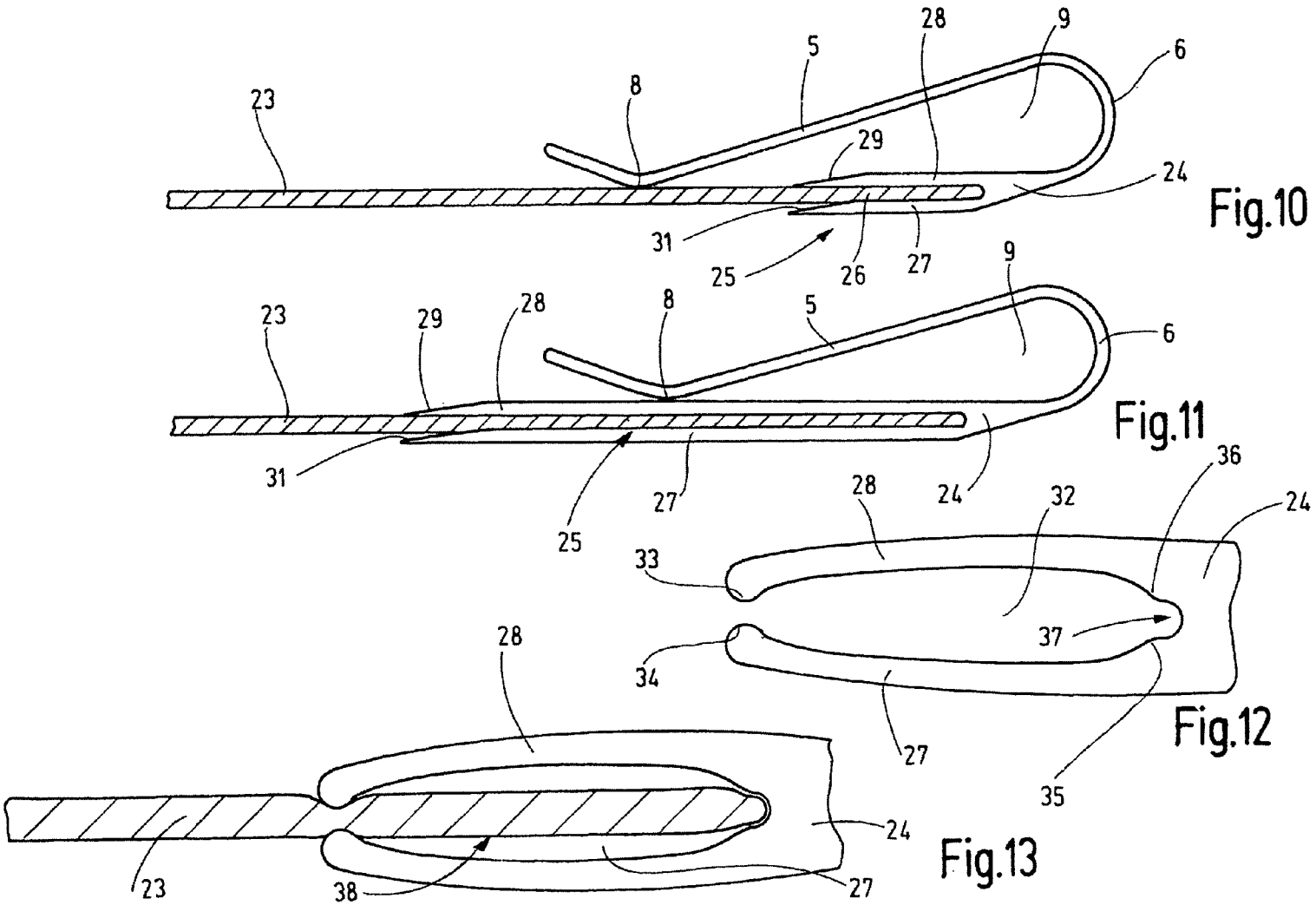
FIG. 12 is a detail of a side view of a section of a needle-holding clip with the specially configured accommodation space for the carrier plate.
FIG. 13 is a detail of a side view of the holding clip and the carrier plate at the point where they are joined.

As is shown by FIG. 9, it is also possible to make the upper wall 28 longer than the outside wall 27. Again, the chamfer 29 facilitates the insertion of the needles under the edge 7, which—as in each of the above-described exemplary embodiments—defines an insertion funnel 30 with the carrier plate 23 or the wall 28 (FIGS. 9 and 11). Again the needle-receiving device 3 is formed by the clamping lip 5 and the carrier plate 23.

Preferably, referring to each embodiment in accordance with FIGS. 7, 8, or especially the embodiment in accordance with FIG. 9, the lower wall 27 may be provided on its slit inside with a chamfer 31 extending toward the slit edge. This facilitates the insertion of the carrier plate 23 into the slit 26. The connection between the carrier plate 23 and the limb 24 may again be established with a connecting means 25, for example, an adhesive.

As shown by FIG. 10, the limb 24 may also be configured shorter than the clamping lip 5. This applies, in particular, when the carrier plate 23 is relatively stiff. Both walls 27, 28 may be provided with the already described chamfers 29, 31 in order to facilitate the insertion of the needles in the inside space 9, on the one hand, and the insertion of the carrier plate 23 in the slit 26, on the other hand.

As shown by FIG. 11, it is also possible to have both walls 27, 28 be longer than the clamping lip 5 and thus be able to extend beyond the contact point 8. Again, there are chamfers 29, 31.

FIGS. 12 and 13 illustrate additional options for connections between the carrier plate 23 and the limb 24. The walls 27, 28, which, in this case, have the same length and are rounded at their edges, enclose an inside space 32 that has a width to be measured perpendicular to the carrier plate 23, width being greater than the thickness of the carrier plate 23. The free end of the walls 27, 28 is provided with rib-like projections 33, 34. Likewise, the bottom of the inside space 32 is provided with rib-like elevations 35, 36 which define a distance 37 between each other. This distance corresponds approximately to the thickness of the carrier plate 23 or is somewhat smaller than the latter.

As shown by FIG. 13, the carrier plate 23 may be provided with recesses that are associated with the projections 33, 34. If the carrier plate 23 is slightly resilient, these recesses may mould into place under the force developed by the projections 33, 34. Consequently, the carrier plate 23 is held in two linear zones that are defined by positioning means, namely by projections 33, 34 as well as by elevations 35, 36. In this manner, the carrier plate 23 can be held in a highly precise manner; the inside space 32 may be additionally be filled with adhesive 38 in order to secure the carrier plate 23 on the limb 24.

Figure 14:
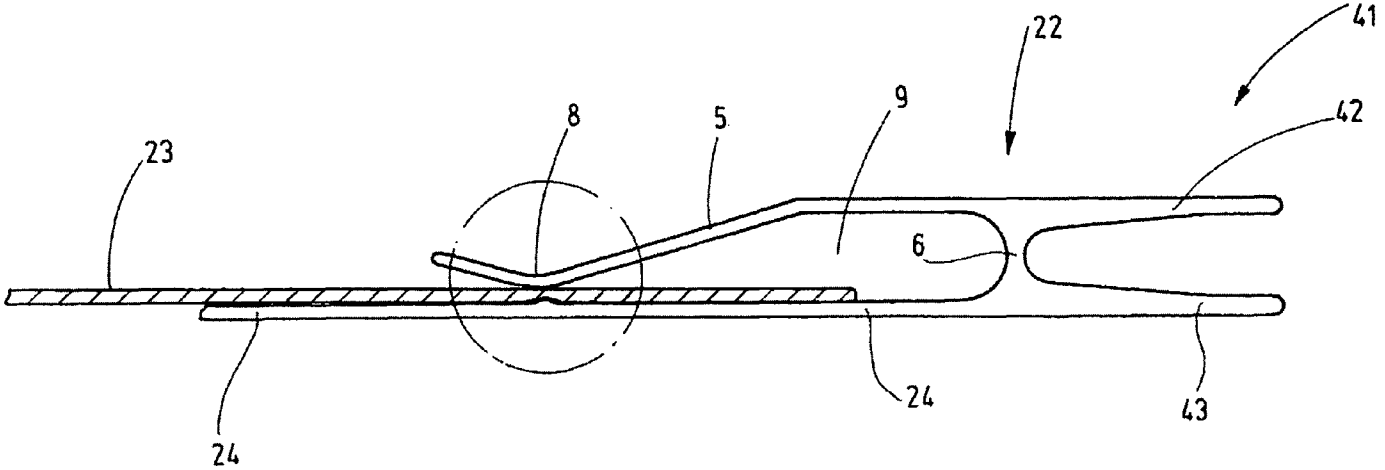
FIG. 14 is a schematic side view of an embodiment of the needle-receiving device with the actuation device and the form-closed attachment of the carrier plate to the needle-holding clip.
Figure 15:
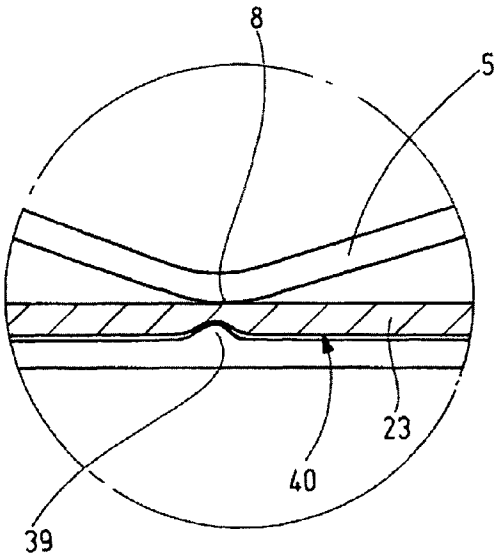
FIG. 15 is an enlarged view of a detail of the carrier plate and the holding clip in accordance with FIG. 14.

FIGS. 14 and 15 show additional modifications. As shown by FIG. 14 in conjunction with FIG. 15, based on the embodiment in accordance with FIG. 7, the limb 24 may have a rib 39 preferably at a point opposite the contact point 8. This rib may have a triangular cross-section and an edge facing toward the limb 5. This edge presses into the carrier plate 23 that exists of cardboard, for example, thereby securing said carrier plate in longitudinal direction. Again, cement 40 may be used for the additional connection of the carrier plate 23 and the limb 24.

As is further obvious from FIG. 14, the needle-holding clip 22 may be provided with an actuation device 14 in order to open and close the clamping lip 5 in a controlled manner. The actuation device 41, for example, consists of extensions 42, 43, which adjoin the limb 24 or the clamping lip 5 and extend beyond the spring section 6 that forms a hinge. The extensions 42, 43 may extend across the entire width of the needle-holding clip 22, which is aligned in direction transverse to the needles and perpendicular to the plane of projection in FIG. 14. Due to the stiff connection between the extension 42 and the clamping lip 5 and due to the stiff connected between the extension 43 and the limb 24, the limb 5 is moved away from the carrier plate 23 when the two extensions 42, 43 are manually compressed, for example. This makes it possible to insert the needles into the inside space 9, without having the contact point 8 graze over the hook and the latch. Furthermore, needles can be removed from the inside space 9, without having the hooks displace the clamping lip 5 out of its tensioned position.

The carrier plate 23 may be made of an absorbent material or be provided with such a material on its entire surface or on part of its surface. This applies to all of the above-described exemplary embodiments.

A needle-holding device 1 suitable in particular as a package comprises a flat needle carrier section 4 and an adjoining section that has a clamping lip 5 that is resiliently biased against the needle carrier section 4. The clamping lip 5 reaches around the stitch-forming sections 10 of the needles 2 which are held lying next to each in contact with each other on the needle carrier section 4. The resiliently yielding clamping lip 5 permits the insertion and the pull-out of one, several or of all the needles 2.

It will be appreciated that the above description of the present invention is susceptible to various modifications, changes and adaptations, and the same are intended to be comprehended within the meaning and range of equivalents of the appended claims.

LIST OF REFERENCE NUMBERS

1 Needle-holding device
2 Needles
3 Receiving device
4 Needle carrier section
5 Clamping lip
6 Spring section
7 Edge
8 Contact point
9 Inside space
10 Stitch-forming region
11 Shaft
12 Parts
13 Foot
14 End
15 Means
16 Package band
17 Border
18 Rubber band
19 Edge
20 Hook
21 Latch
22 Needle-holding clip
23 Carrier plate
24 Limb
25 Connecting means
26 Slit
27 Wall
28 Wall
29 Chamfer
30 Funnel
31 Chamfer
32 Inside space
33 Projection, positioning means
34 Projection, positioning means
35 Elevation, positioning means
36 Elevation, positioning means
37 Distance
38 Adhesive
39 Rib
40 Adhesive
41 Actuation device
42 Extension
43 Extension
44 Bending line
L Length

The invention claimed is:

1. Needle-holding device containing a plurality of machine knitting needles with hooks at one end, with the holding device comprising:

a receiving device that has a flat needle carrier section and a clamping lip opposite said needle carrier section and extending across the entire width of said needle carrier section, wherein the clamping lip bridges said one end of the plurality of needles, which are arranged adjacent one-another on said needle carrier section and clamps the individual needles against the needle carrier section and thus holds said needles in place; and wherein the receiving device comprises a needle-holding clip connected to one end of a separate carrier plate which forms said needle carrier section, and the clamping lip is configured as a part of the needle-holding clip; the needle-holding clip is formed by the clamping lip, by a limb that extends beneath said clamping lip and that is connected to one end of and holding the carrier plate, and thus the needle carrier section, and by a spring section that connects the limb and the clamping lip, that biases the clamping lip towards said limb, and that provides an inside space accommodating the hooks of the needles without touching the hooks of the needles, while biasing the clamping lip toward the carrier plate; one end of the carrier plate extends between the clamping lip and the limb into the inside space and is fastened to the inner surface of the limb, whereby the carrier plate is supported by the limb; the inner surface of said carrier section onto which the needles are clamped contains no projections that would hinder sliding of a needle along said inner surfaces for insertion into said inside space; and the clamping lip has an edge that is bent away from the needle carrier plate to form an insertion funnel to facilitate the insertion of the needle hooks into the inside space, with said edge of the clamping lip having a height from the inner surface of said carrier plate when no needle is being clamped that is greater than the height of the hook of a needle positioned with its needle back on the inner surface of the carrier plate.

2. Needle-holding device in accordance with claim 1, wherein the carrier plate consists of a different material than the needle-holding clip and is connected to said clip by a connecting means.

3. Needle-holding device in accordance with claim 1, wherein the carrier plate, at least in part, is formed of an absorbent material that contains a treatment agent for the needles, and the carrier plate is set up for the release of the treatment agent.

4. Needle-holding device in accordance claim 1 wherein the needle-holding clip is provided with an actuation device for moving the clamping lip away from the carrier section.

5. Needle-holding device in accordance with claim 1, further including at least one band extending across the needle carrier section to aid in maintaining the needles on the carrier section.

6. Needle-holding device in accordance with claim 5, wherein the at least one band is an elastic band that surrounds the needle carrier section.

* * * * *